US005131199A

United States Patent [19]

Clark

[11] Patent Number: 5,131,199

[45] Date of Patent: Jul. 21, 1992

[54] ARCHITECTURAL WINDOW SYSTEM WITH INTERCHANGEABLE SASHES

[75] Inventor: Donald J. Clark, Reno, Nev.

[73] Assignee: V.I.E.W.S., Inc., Reno, Nev.

[21] Appl. No.: 565,677

[22] Filed: Aug. 10, 1990

[51] Int. Cl.[5] ..... B44F 3/00; E04C 2/54; E06B 3/72

[52] U.S. Cl. ..... 52/311; 52/314; 52/456; D25/103

[58] Field of Search ..... 52/204, 201, 455, 456, 52/85, 202, 311, 475, 507, 764, 765, 777, 314; D25/103, 104, 106, 111

[56] References Cited

U.S. PATENT DOCUMENTS

| | | | |
|---|---|---|---|
| 237,416 | 2/1881 | Tiffany | D25/106 |
| 274,948 | 4/1883 | Farge | D25/106 |
| 287,768 | 10/1883 | Miles | 52/311 |
| 865,834 | 9/1907 | Watkins | 52/456 |
| 1,619,631 | 3/1927 | Patasnik | 52/311 |
| 1,709,267 | 4/1929 | Horton | 52/311 |
| 2,060,892 | 11/1936 | Pettit | 52/455 X |
| 2,094,294 | 9/1937 | Garritsen | 52/456 |
| 2,188,056 | 1/1940 | Klyper | 52/455 X |
| 3,713,958 | 1/1973 | McCracken | D25/106 |

FOREIGN PATENT DOCUMENTS

| | | | |
|---|---|---|---|
| 11553 | 8/1854 | France | 52/475 |
| 538048 | 6/1922 | France | 52/456 |
| 2420638 | 11/1979 | France | 52/204 |
| 25114 | 11/1901 | Switzerland | 52/311 |

OTHER PUBLICATIONS

Spectra Studios Brochure: Oct. 1980, pp. 1-10 and Front & Back Cover.

"Andersen Commercial Group 1988 Commercial Product Catalog" Andersen Corporation, Bayport Minn. 55003.

*Primary Examiner*—Michael Safavi

*Attorney, Agent, or Firm*—Thomas M. Freiburger

[57] ABSTRACT

A window system has matching groups of window sashes which enable the creation of a great number of different window array patterns using modular, interchangeable sashes. The sashes have light-dividing mullions which intersect with the sash frame at a particular level or width point such that another sash when positioned adjacent to the sash will have its mullion or mullions positioned to continue the same mullion line through the two sashes. In preferred embodiments the sashes are all rectangular, some groups with linear mullions and some groups with diagonal, arcuate or elliptical mullions.

1 Claim, 9 Drawing Sheets

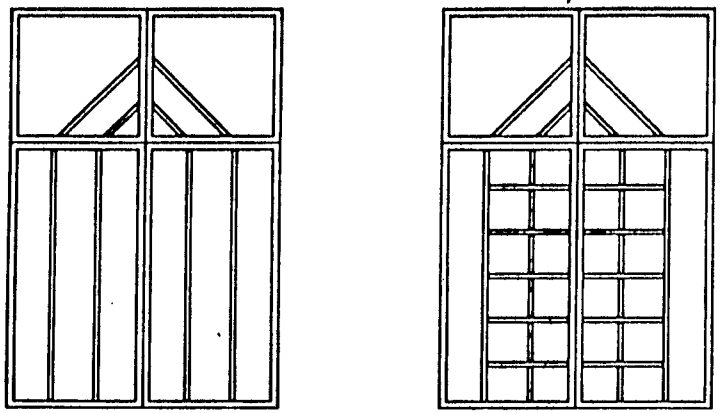
Fig. 6
Fig. 7
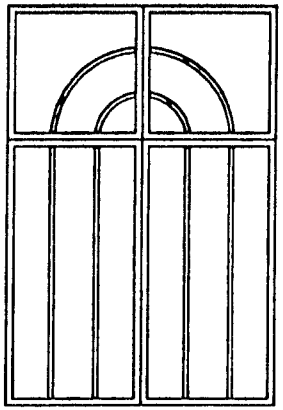
Fig. 8
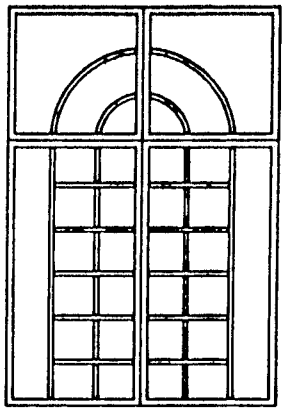
Fig. 9
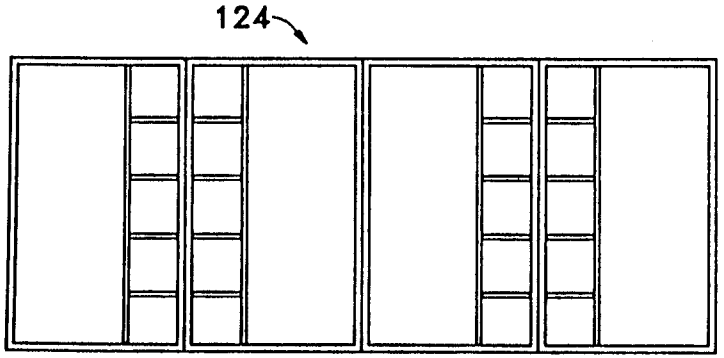
Fig. 10
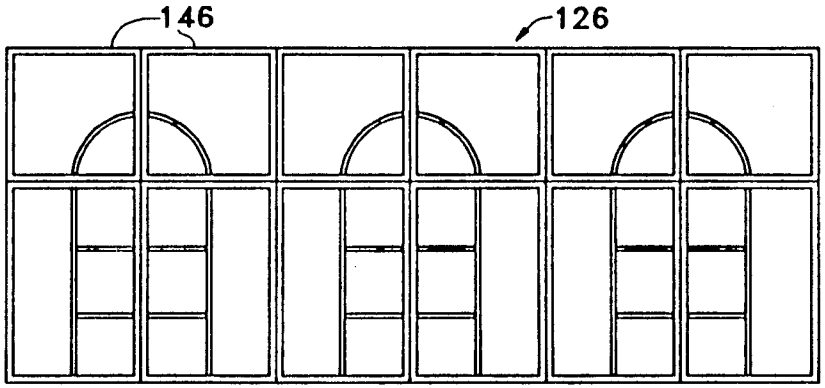
Fig. 11

ARCHITECTURAL WINDOW SYSTEM WITH INTERCHANGEABLE SASHES

BACKGROUND OF THE INVENTION

This invention relates to architectural windows for structures, and more particularly to a system of windows with interchangeable sashes for building a variety of different larger window arrays or patterns.

In the design of residential housing and commercial buildings, a number of different types of windows, window sashes and window systems have been used. In some cases individual, pre-manufactured sashes have been arranged in different patterns, although not with features similar to the present invention.

One manufacturer, Andersen Corporation, has marketed collections of window units which can be arranged together into various assemblies forming desired patterns, particularly with certain peripheral outlines. That system, however, as demonstrated in the Andersen brochure, "Windows and Gliding Doors—1988 Commercial Product Catalog", page 10, did not embody the features of the present invention in regard to interchangeability, side-by-side mating and continuity of interior lines with a plurality of different rectangular window sashes or modules. In particular, the Anderson system tends to create patterns using whole sashes assembled together, not using the dividing mullions of divided light windows to create pattern which continue from sash to sash.

Neither the Andersen system nor any other previous system or pattern of window sashes has had the features of interchangeability, versatility in producing a nearly infinite variety of window and mullion patterns, and pleasing continuity of lines and patterns as in the system of the present invention described below.

SUMMARY OF THE INVENTION

In the window system of the present invention, a large collection of individually framed window sashes or modular window components are included, each being capable of assembly together with one or more differently-configured sashes. The sashes are preferably all rectangular, and at least most of them include dividing mullions which establish two or more "lights" or window panes in the sash.

As described herein and in the claims, the term "mullions" or "sashes with mullions" refers not only to integral or fixed mullions in so-called true divided light windows, but also to window sashes with wood, plastic or metal inserts or "grilles" serving as artificial mullions over a single piece of glass or mounted between separate layers of glass. The description and claims are also intended to cover sashes and collections of sashes having provision for receiving such artificial mullions or grilles in patterns according to the principles of the invention.

In one group of sashes of the system, the mullions are positioned to provide horizontal lines or vertical lines or both, which can establish a right-angled grid. In a second group of sashes, the mullions are not all in horizontal or vertical lines, but include oblique lines or arcuate or elliptical patterns in the mullions.

In all cases, the mullions have termini at the sash frame at points which will match with the locations of similar points in an adjacent, complementing sash in order to provide an appearance of continuity. Thus, a pair of sashes having a quarter-circle arcuate mullion at a lower corner can be put together side by side, mirror-image, to form a half-circle arch pattern. Similarly, sashes having vertical/horizontal grid mullions may be positioned below the arch-containing sashes so that the lower ends of the arcuate mullions appear to continue down into vertical lines of the lower sashes.

Four of the first-described type of sash can be put together to form a circular mullion pattern. Inner and outer circles or arches can be formed by assembling sash units having more than one concentrically arranged arcuate mullion. Similarly, ellipses or portions of ellipses or other curves can be formed with the continuity of the adjacent mullions, in the same way.

In the system of modular window sashes of the invention, an unseen grid exists through all sashes of a collection which can be used together, and through an assembled array. Thus, if the sashes are in a collection having integral foot dimensions for different sized sashes (such as three feet by four feet, three feet by five feet, three feet by six feet, etc.), the grid might comprise horizontal lines generally at one foot spacings and vertical lines at one foot spacings. Sashes of this collection will have mullions which lie on one or more lines of the grid or which have terminus points at their frames which lie on the grid.

The collection can have some sashes with no dividing mullions whatsoever; however, most sashes have at least one mullion and many have a series of parallel vertical mullions, a series of parallel horizontal mullions, a combination of both or curving or oblique mullions.

Sashes can have mullions only at one or several lines on the grid, with a large single light or pane defined by the remainder of the sash. Thus, for example, a sash of three foot horizontal dimension and four foot vertical dimension may have a vertical mullion one foot from one edge of the frame; the divided one foot wide area may be further divided by three horizontal mullions, equally spaced. This produces in the sash one large light and four small, one foot by one foot lights adjacent to one side of the frame. Such a sash can be used adjacent to any other complementing sash which will enable the mullion lines to appear continuous across the frames. For example, it can be abutted against a similar sash in mirror image fashion, to provide a grid of eight windows. To this assembly can be added a pair of sashes of similar width dimension, each with a quarter-circular arcuate mullion, an elliptical mullion or an obliquely angled mullion. With the mullion termini positioned on the unseen grid as described above, this will produce a window array having ten small panes including an arch or a triangle shape at top, with these small panes or lights surrounded by larger lights.

In one preferred embodiment of an assembly, the arrays of window sash components are assembled with four-corner intersections, that is, with frame edges of adjacent sashes aligned vertically and horizontally. In this way, the mullions form all internal sash patterns which continue from sash to sash. The frame lines are somewhat heavier, forming a grid which does not interfere aesthetically with the pattern created by the mullion lines, and actually enhances the pattern. However, in other embodiments some of the mullions may flow into frame lines of adjacent frames, so that the internal pattern of the window array is formed by both mullions and adjacent sash frames. In this latter arrangement the center line of a mullion preferably aligns with the outer edge of an adjacent sash which does not extend the full height or width of the first sash.

Thus, in simplest terms, a system of modular window components in accordance with the present invention includes a plurality of rectangular framed window component modules or sashes, each with a frame and with means for connection to an abutting window component or sash. Each rectangular window component module or sash has side and top and bottom dimensions which are equal to other, abuttable sashes of the system.

At least some of the sashes are divided light window sashes, with mullions dividing the sash into multiple lights or panes (whether true divided light or not). The collection of sashes includes at least two different configurations of divided light window sashes, and preferably many different configurations.

The different divided light window sashes have dividing mullions which are coordinated with each other as to position in the sash. They are coordinated in such a way that the different sashes can be abutted along their frame edges with termini of the mullions at the respective abutted frames juxtaposed to give an appearance of continuity of the mullions through the adjacent sashes. In some cases the continuity may extend from a mullion into an adjacent sash frame edge or into a line formed between a pair of adjacent sash frame edges.

In preferred embodiments the system or collection of sashes includes sashes having obliquely angled linear mullions dividing a window component such that a triangular light is formed in at least one corner of the sash. In such sashes the distance of each terminus of the oblique mullion from an adjacent frame corner is matched to the position of a mullion terminus at another, dissimilar window sash.

One form of assembled system in accordance with the principles of the invention includes a series of dissimilar modular window sashes with different mullion arrangements, and the assembled array has an unseen grid of horizontal and vertical lines. All mullions of the assembly, including vertical and horizontal mullions and non-vertical, non-horizontal mullions, have termini at frame edges at points on the grid.

It is therefore among the objects of the present invention to produce an architectural window system having a series of different components which comprise modular window sashes interconnectable with each other in various ways to form architectural patterns with mullions in the sashes. The invention takes assemblable window components beyond any previous system in respects of versatility, ease of assembly and the patterns which can be produced. These and other objects, advantages and features of the invention will be apparent from the following description of preferred embodiments, considered along with the accompanying drawings.

DESCRIPTION OF THE DRAWINGS

FIGS. 3 through 9 are diagrammatic elevation views showing examples of additional window patterns which can be produced using the modules shown in FIG. 2. The arrays of FIGS. 6 through 9 may be repeated into wider assemblies as in FIGS. 1, 3, 4 and 5.

FIGS. 10 through 18 show additional examples of architectural window assemblies which may be produced using the basic modular window components shown in FIG. 2, in some cases with some dimensional modifications.

DESCRIPTION OF PREFERRED EMBODIMENTS

Figure 1:
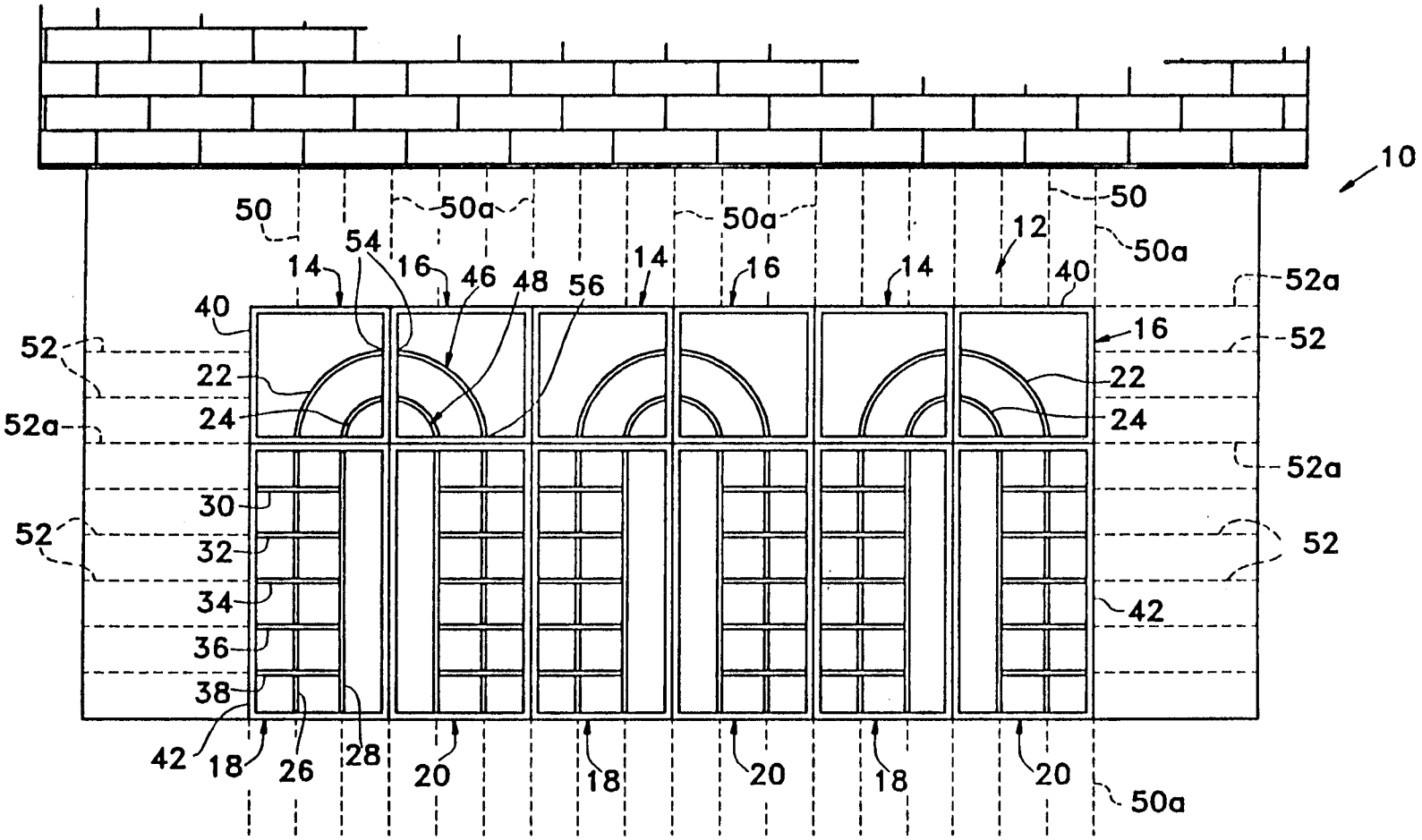
FIG. 1 is a somewhat diagrammatic elevation view showing an assembly of 12 window component modules or sashes in an architectural array wherein each framed sash has internal mullions which line up with those of adjacent sashes, producing a pattern with an appearance of continuous mullions.

In the drawings, FIG. 1 shows in elevation a portion of a building 10 having an architectural window assembly or array 12 formed in accordance with the invention.

The window array 12 shown in FIG. 1 has twelve different modular window component sashes—six upper sashes 14 and 16, which in this case are in mirror image pairs; and lower window sashes 18 and 20, which again in this array are mirror images of each other. Each window sash includes internal mullions dividing the sash into multiple lights or panes, and the mullions "flow together" or give the appearance of continuity from sash to sash as illustrated, thereby producing a pleasing architectural pattern using separate components.

In the sashes 14 and 16, arcuate mullions 22 and 24 divide the sash into three lights. In each of the lower sashes 18 and 20, internal mullions 26 and 28 extend vertically as shown, dividing the total sash space preliminarily into vertically elongated thirds; two-thirds of the space is again divided by equally spaced horizontal mullions 30 through 38, so that these spaces are divided into sixths, with the sash thus having thirteen lights.

Figure 34:
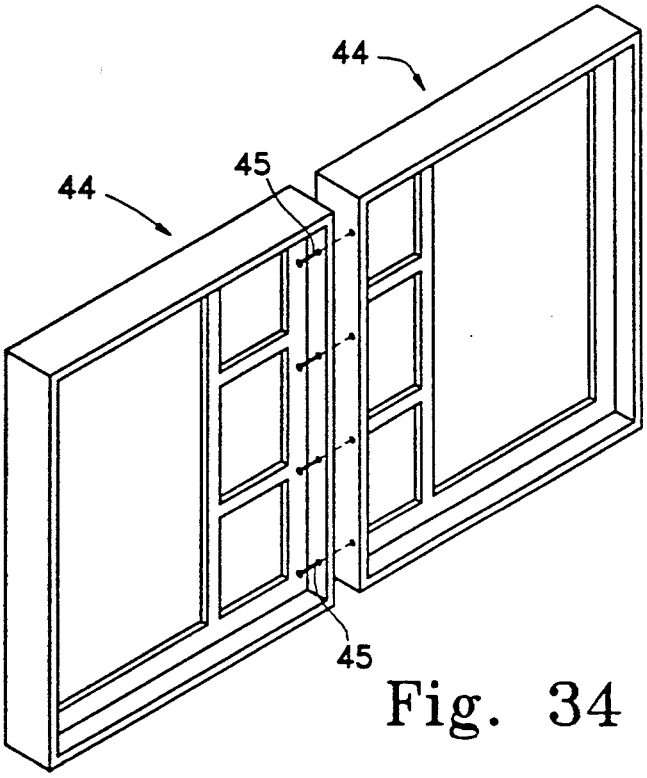
FIG. 34 is an exploded assembly view in perspective showing one example of a type of structural connection which may be used to connect adjacent window sashes.

Each modular window sash component 14, 16, 18 and 20 includes a peripheral frame 40 or 42, as shown in FIG. 1. The peripheral frames may be heavier and deeper in cross section than the mullions, enabling the system to be assembled as illustrated such that sufficient strength is established in the overall assembly or array. FIG. 34 shows one example of the manner in which adjacent, abutted window frames 44 may be attached together—simply by a series of wood screws or construction nails 45, in the case of an embodiment of the system employing wooden frames.

As is seen from FIG. 1, the components of the invention are configured so as to be assembled with at least some mullion lines appearing to continue from sash to sash. Thus, a single mullion line 46 is formed from the mullions 26 and 22, and appears to be patterned up through the sash component 18, through a half-circular arc in the sashes 14 and 16, and back down through the adjacent sash 20. The mullion line 46 provides the appearance of an arch. Similarly, a mullion line 48 is produced by the same four sashes, giving the appearance of an inner arch.

The horizontal dividing mullions 30 through 38 also lie on mullion lines at common levels, giving a line continuity. The mullions appear to be continuous across frame divisions such as between the sash 20 and the next adjacent sash 18 on its right. Not every mullion need show continuity with an adjacent sash.

FIG. 1 shows a series of vertical grid lines 50 and horizontal grid lines 52 which help illustrate the principles of the invention. As these grid lines point out, each sash in the system of the invention, i.e. each sash having mullions, has its mullions either lying on one or more of these grid lines or at least has its mullions with termini 54 and 56 lying on the grid (in the case of non-vertical, non-horizontal mullions). It is this property which enables the internal mullions to give the appearance of continuous lines.

Figure 35:
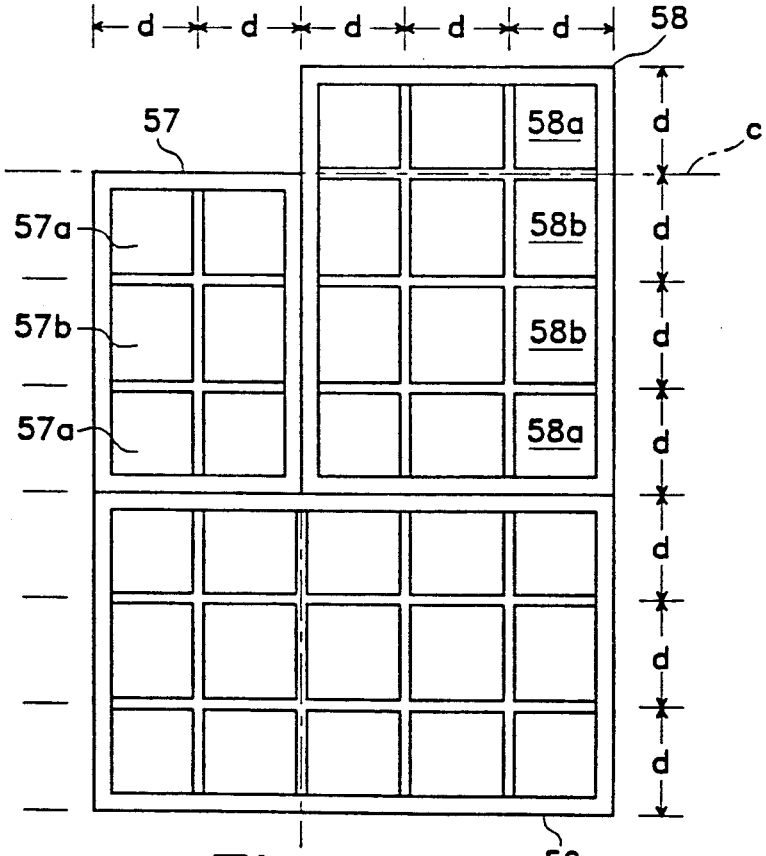
FIG. 35 is a schematic elevation view showing three abutting sashes and illustrating dimensional construction of the sashes in accordance with principles of a preferred embodiment of the invention.

FIG. 1 also shows vertical and horizontal grid lines 50*a* and 52*a* which in one preferred embodiment are at regular spacings with the lines 50 and 52. These grid lines 50*a* and 52*a* coincide with edges of sash frames in the window array shown in FIG. 1. Although the equal spacing of these lines on the grid is not particularly important in the window assemblies of FIGS. 1, 3–18 and 24–27, it is important in the types of assemblies shown in FIGS. 28–33, where some mullions follow lines from adjacent sash edges rather than adjacent mullions, as further discussed below. In the preferred embodiment, a uniformly spaced grid establishes locations of mullion center lines and of all sash frame outer edges. This is generally indicated in the drawings, and it enables assemblies such as shown in FIGS. 28–33 to be made without throwing the grid arrangement out of phase due to the greater width of a pair of abutted sash frames as compared to the width of a mullion. FIG. 35 illustrates this preferred construction, wherein adjacent sashes 57, 58 and 59 all have a grid spacing d. This requires that edge panes or lights such as 57*a* and 58*a*, for example, be smaller than interior lights 57*b* and 58*b*, since the grind lines follow sash outer edges and mullion center lines. Along lines such as the grid line c, where a single sash frame edge runs into a mullion center line, the eye nonetheless tends to see continuity of line.

It should be understood, however, that in some embodiments of the invention the general grid spacing d need not be followed in the outer lights of the sashes such as the light 58*a* and 57*a*. If the collection of sashes is used only to form assemblies such as shown in FIGS. 1, 3–18 and 24–27, wherein sash edges are arranged along common lines, without interruption of any sash edge lines in the window assembly, then the panes or lights at the ends of window sashes may be of the same dimensions as interior panes, without any need to compensate for the increased width of the sash frames as compared to the width of the mullions.

Figure 2:
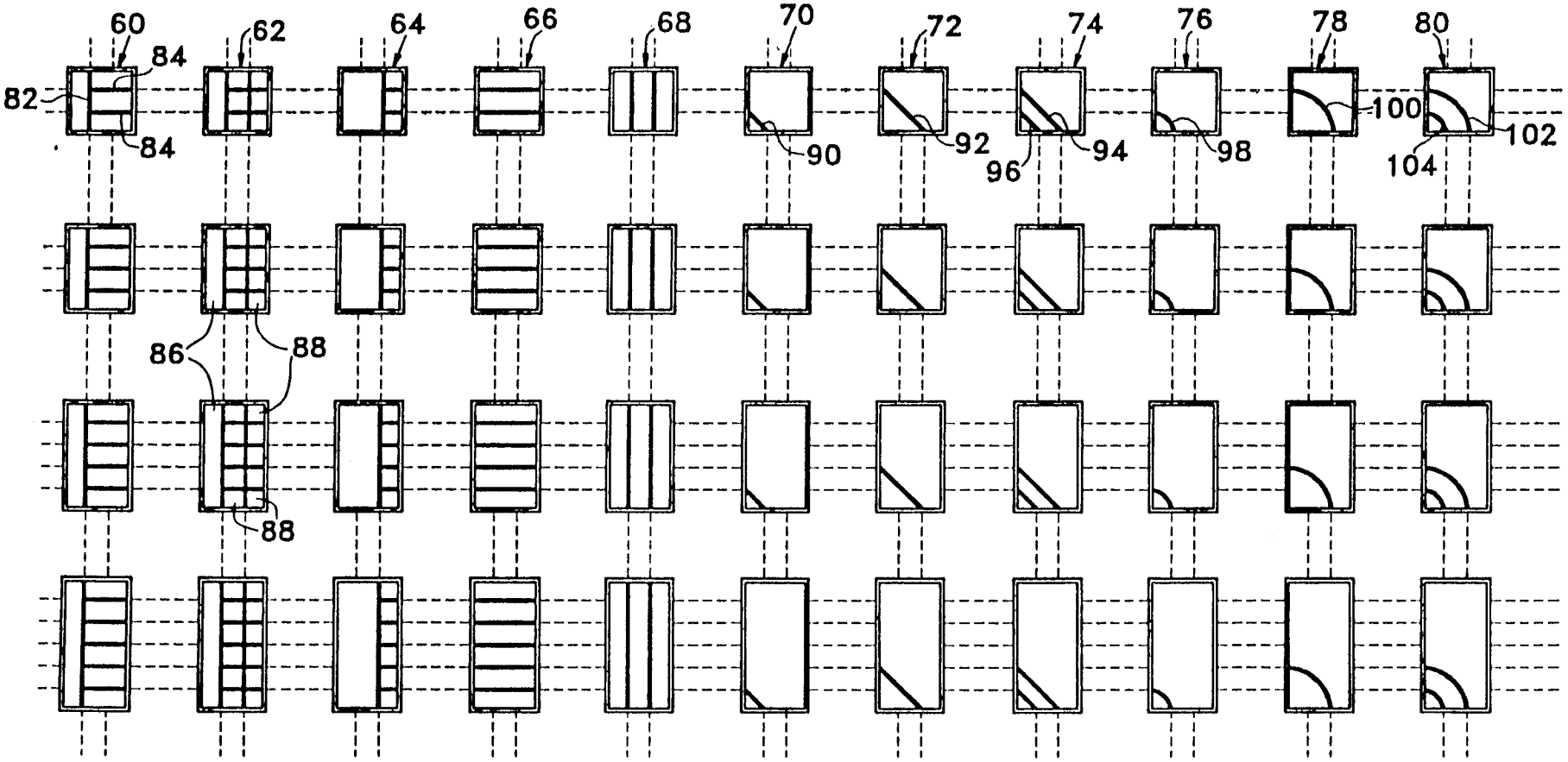
FIG. 2 shows a series of modular rectangular window components or sashes which follow the principles of the present invention and which can be used to produce a wide variety of different architectural window arrays, such as the array shown in FIG. 1. Many other sash configurations are possible in addition to those shown in FIG. 2.

FIG. 2 shows a collection of modular window sash components representing examples of components which can form a part of the system of the invention. This list is not exhaustive. As indicated, these may include groups 60, 62, 64, etc. through 80. The groups 60, 62, 64, 66 and 68 are of a first general type or configuration wherein mullions are arranged in vertical or horizontal lines. As shown in the drawing, these can include vertical mullions 82 as in the group 60, which divide window space at a one-third point, with the remaining two-thirds divided by horizontal mullions 84. Within the group 60, the outer dimensions of the window sashes can be in increasing vertical increments, such as one foot or 18 inches increase in the height of the sash with each progressively taller model, and consequently with one additional horizontal mullion defining one additional light or pane with each increase in height of the sash.

The remaining groups 62 through 68 are similar in that the vertical dimension can vary, so long as the horizontal mullions are spaced in accordance with a grid, which is again indicated in dotted lines in FIG. 2.

It should be understood that the width dimension may also vary within a given collection of sashes of a window system of the invention, although that aspect is not specifically illustrated in these drawings.

The group of window sashes 62 illustrates that sashes can have one vertical pane or light 86, with the remainder of the window divided into a plurality of small lights 88 in a traditional grid-like pattern.

The other groups 64, 66 and 68 show other combinations of mullions, with the groups 66 and 68 showing all horizontal mullions and all vertical mullions, respectively.

The window sash groups 70 through 80 represent a different general type of mullion arrangement, wherein the mullion or mullions are non-vertical and non-horizontal, or at least include such mullions. Thus, the sashes may include oblique mullions 90, 92, 94, 96 as shown in the group 70, 72 and 74. These may be at 45° as shown, or they can be at other oblique angles, as discussed further below.

The mullions may also include non-linear mullions, such as the arcuate or curvilinear mullions 98, 100, 102, 104 shown in the groups 76, 78 and 80 of FIG. 2.

As again indicated by dashed grid lines in FIG. 2, the mullions, or in some cases the termini or frame intersection points of the mullions, always lie on the grid lines so that the aesthetic purposes of the invention are served. The grid lines in FIG. 2 do not include lines along the outer sash frame edges as discussed above. Although a uniformly spaced grid is preferred, including the outer sash lines, this is not necessary in all embodiments.

It is also emphasized that the grid spacings representing vertical spacing between mullions need not be equal to the horizontal grid spacings between mullions, for a particular collection of sashes. Even though the horizontal and vertical spacings are shown the same in the drawings, it is not intended that these examples represent every embodiment.

Figure 3:
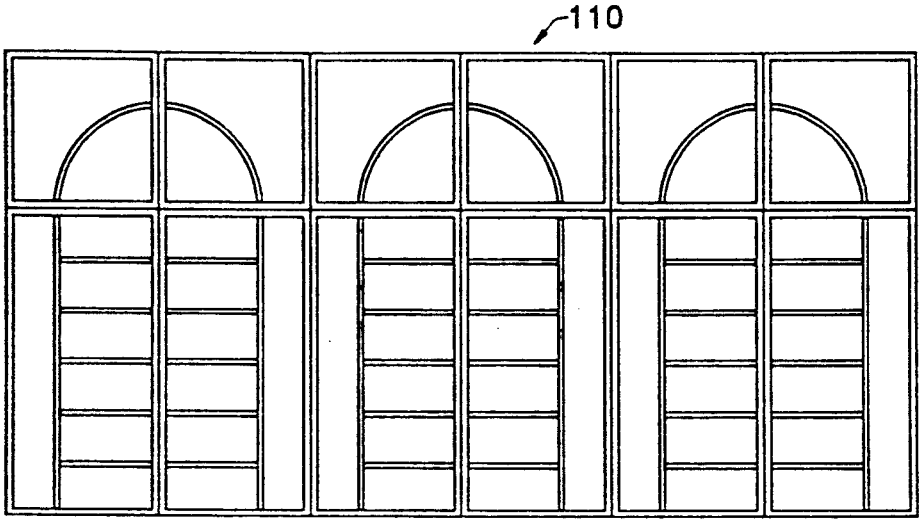
Figure 4:
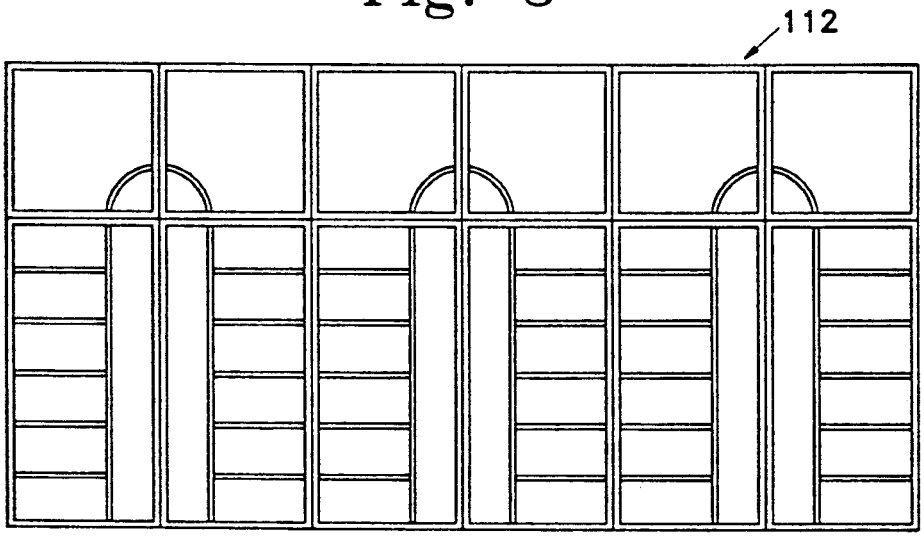
Figure 5:
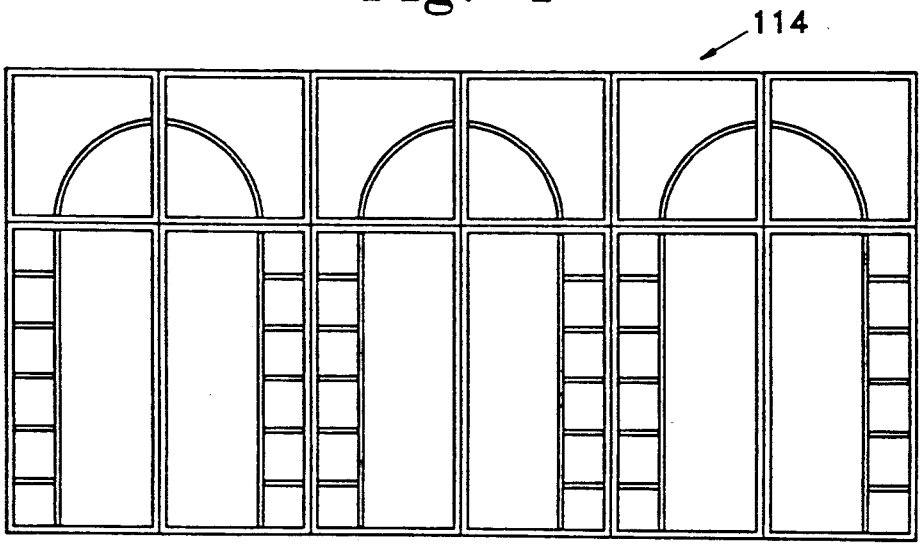
Figure 14:
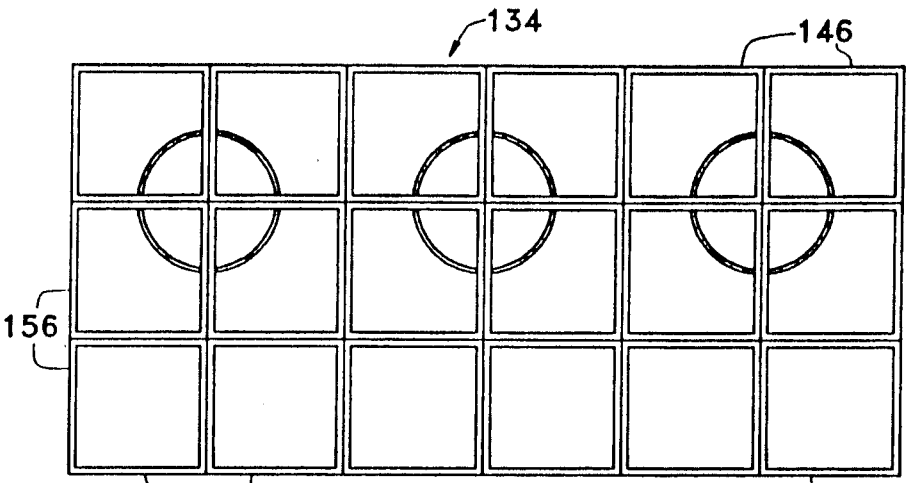
Figure 13:
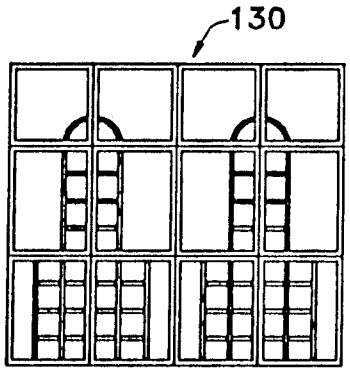
Figure 12:
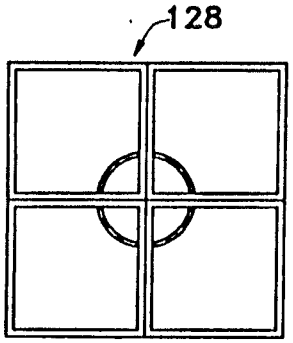
Figure 18:
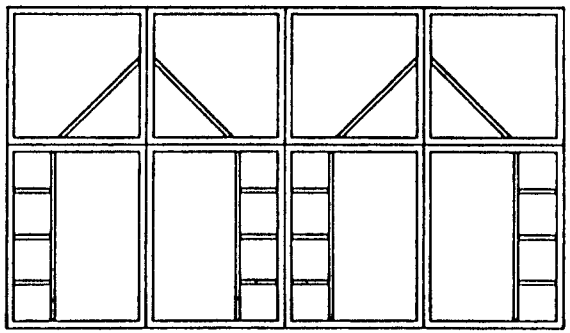
Figure 17:
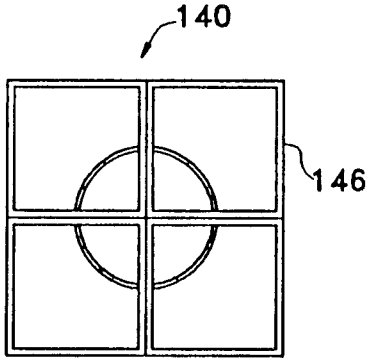
Figure 16:
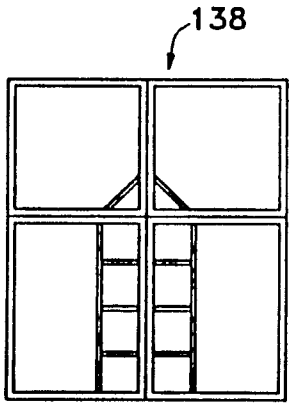
Figure 15:
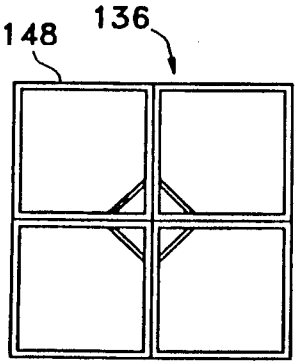

FIGS. 3, 4 and 5 show other twelve-sash variations of the window array 12 illustrated in FIG. 1. The window arrays 110, 112 and 114 shown in FIGS. 3 through 5 are assembled from various of the components shown in FIG. 2, as is the array shown in FIG. 1. As can be seen from all of these exemplary arrays, the termini of all mullions lie on the grid lines as outlined in FIG. 1 and as also illustrated in FIG. 2.

It should be understood that although the vertical grid lines are shown at one-third points in FIGS. 1 through 5, they can be at any other desired spacing, and in fact, as mentioned above, their spacings need not match the spacings between the horizontal grid lines.

FIGS. 6 through 10 show further architectural window array patterns which can be made using the modules of the system. Again, these window arrays 116, 118, 122 and 124 are produced using window sash modules taken from the collection shown in FIG. 2.

FIGS. 11 through 18 show further examples of window sash arrays 126 through 142. In all of these figures the architectural window assemblies can again include the basic module and mullion configurations shown in FIG. 2, although some figures show some dimensional and frame-division modifications. Thus, the window arrays 126, 134 and 14 shown in FIGS. 11, 14 and 17 have mullions arranged on a grid which divides each sash into halves left and right, rather than thirds as shown in FIG. 2. This is also true in the horizontal grid (vertical spacing) of some of these sashes. Further, there are included plain, single-light sashes 144 in the arrays of FIG. 14, which sash type is not shown in FIG. 2. As indicated in FIGS. 12, 14, 15 and 17, full-circle or diamond patterns can be formed using four sashes 146 with quarter-circle mullions or four sashes 148 with oblique mullions.

As can be seen from FIGS. 11 through 18, the mullions of these window sashes and window arrays lie on unseen grid lines, however those grid lines are spaced for the particular window array and sash collection. This creates the appearance of continuity from sash to sash, as shown particularly with the circles formed in FIGS. 12, 14 and 17.

Figure 21:
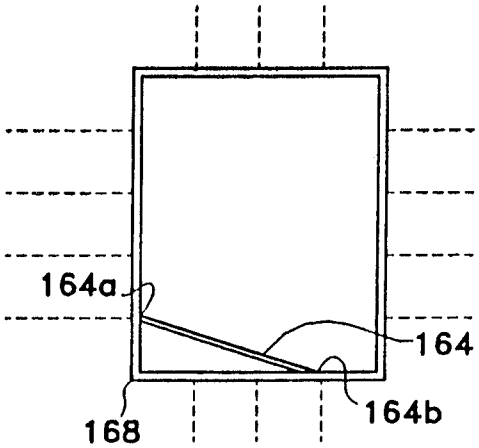
FIGS. 19 through 23 show further examples of modular window sashes which may be included in the system of the invention and used to produce various architectural window patterns. These figures illustrate only one example of relative dimensions and proportions which these sash components may take.
Figure 20:
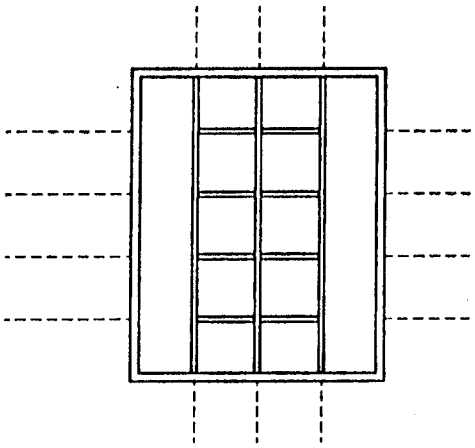
Figure 19:
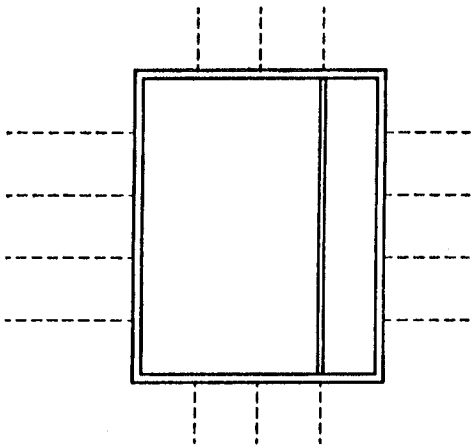
Figure 23:
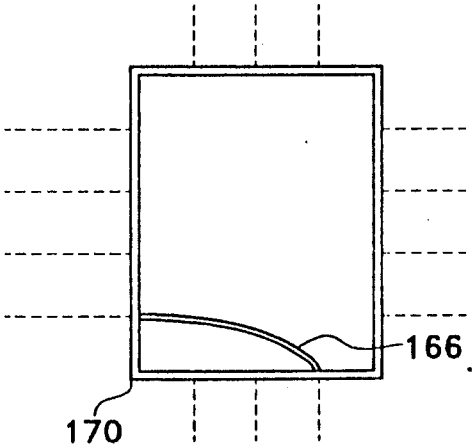

FIGS. 19 through 23 show further modular window sash variations which are not shown in the other drawings. FIGS. 21 and 23 show oblique and elliptical mullions 164 and 166 wherein the two terminus points of the mullion (164*a* and 164*b* in FIG. 21) are not equidistant from the same corner 168 or 170, respectively. Nonetheless, the terminus points still lie on the system's grid lines, as demonstrated in the drawing Figures.

Figure 22:
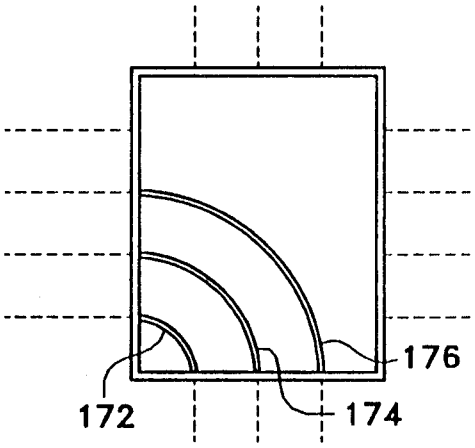

FIG. 22 shows a series of three quarter-circle arcuate mullions 172, 174 and 176 included in one sash.

FIGS. 24 through 27 show further examples of window arrays in accordance with principles of the invention. As illustrated in the array 178 of FIG. 24, patterns can be achieved with mullions appearing to continue across sashes in some directions but not in others. Thus, oblique mullions 180 and 182 match with adjacent mullions in a sash to the left, but do not meet mullions immediately below.

Figure 25:
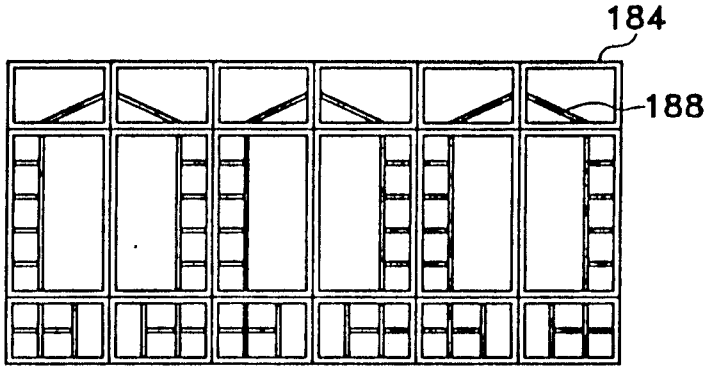
FIGS. 24 through 27 show further examples of window assemblies which can be produced in accordance with the invention. The arrays are assembled with four-corner intersections, i.e. frame lines, continuous to the edges of the assembly.
Figure 27:
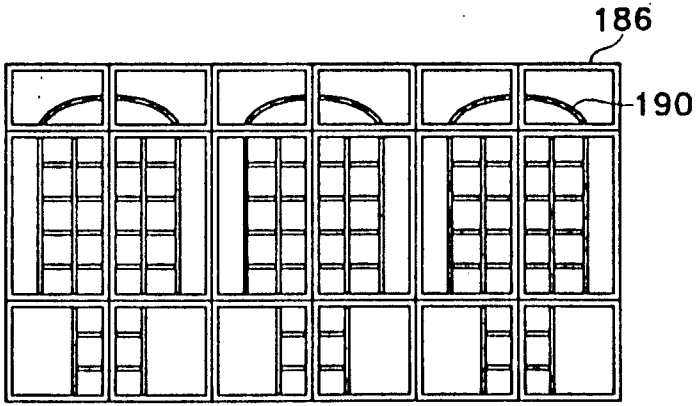
Figure 24:
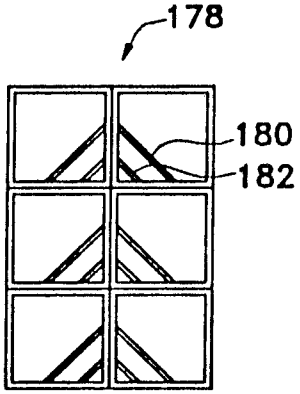
Figure 26:
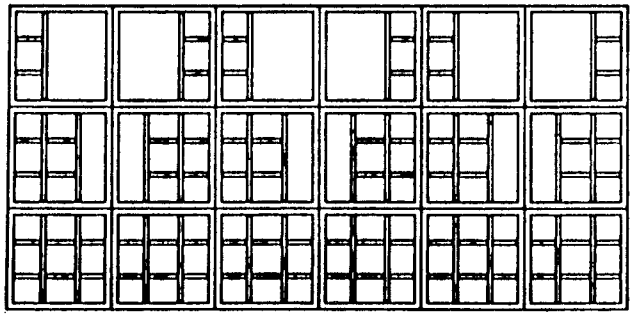

FIGS. 25 and 27 show the use of sashes 184 and 186 of the general types shown in FIGS. 21 and 23 (but with dimensions and proportions somewhat different). These oblique and elliptical mullions 188 and 190 at their upper terminus points are on a horizontal line grid which divides the sash vertically in half; but at their lower terminus points they are on a vertical line grid which divides the sash in thirds. They meet with vertical mullions in sashes below.

All of the window array assemblies discussed above have been assembled with four-corner intersections, i.e. with horizontal sash frame lines extending through the assembly and vertical sash frame lines extending uninterrupted through the assembly. This can be seen, for example, in the arrays of FIGS. 24–27. In accordance with one preferred embodiment of the invention (represented in all of FIGS. 1, 3–18 and 24–327), all sash arrays are put together in this way. This produces a mullion pattern which gives appearance of continuity from sash to sash, and separately produces a rectangular pattern made by the abutting window frames themselves.

Figure 28:
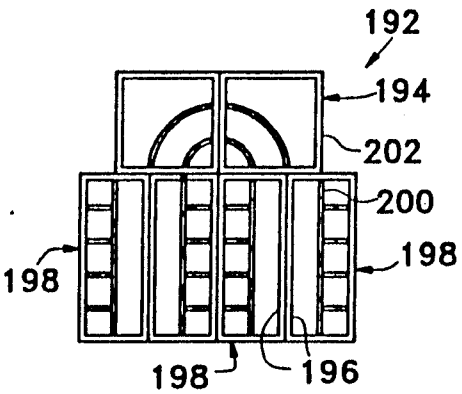

However, in another embodiment or group of embodiments of the invention, the arrays can be formed with some of the sash frames not aligned with frames of an adjacent sash. This is illustrated in FIGS. 28 through 33. As those arrays show, a mullion of one sash can meet with a frame edge of an adjacent sash or with a pair of abutting frame edges of an adjacent sash. FIG. 28 shows an array 192 wherein upper sashes 194 have curving mullions which appear to continue down into a vertical line formed by a pair of adjacent, abutted frame edges 196 of horizontally mated sashes 198. In the same assembly, a vertical mullion 200 of the sashes 198 at left and right appears continuous with a vertical frame edge 202 in the sash 194.

Figure 30:
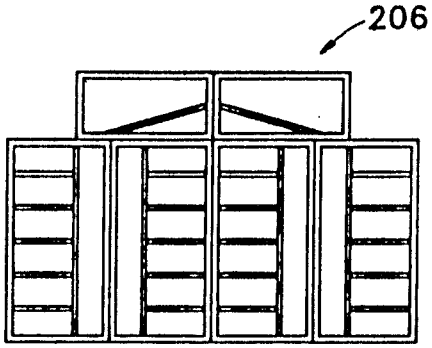
FIGS. 28 through 33 are further views showing examples of a somewhat different form of assembly wherein mullions sometimes continue into frame lines of adjacent sashes.
Figure 29:
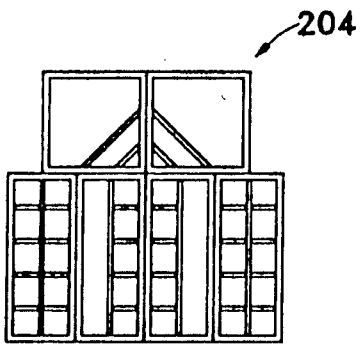
Figure 31:
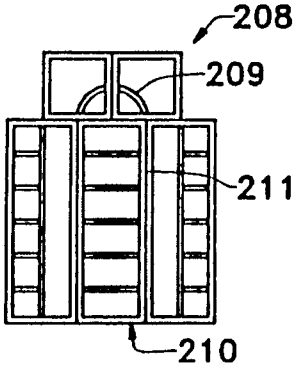

FIGS. 29, 30 and 31 show similar situations in arrays 204, 206 and 208 with different sashes and/or different proportions. In the array 208 of FIG. 31, there is no center mullion or frame edge line in a center, lower window component sash 210. Further, curving mullions 209 appear to continue in a line 211 of abutting sash frame edges below.

Figure 33:
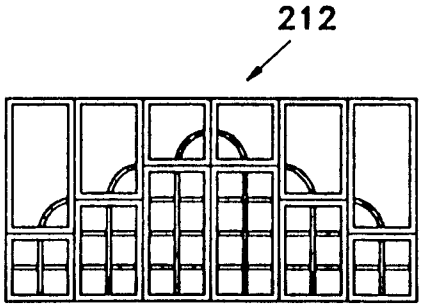
Figure 32:
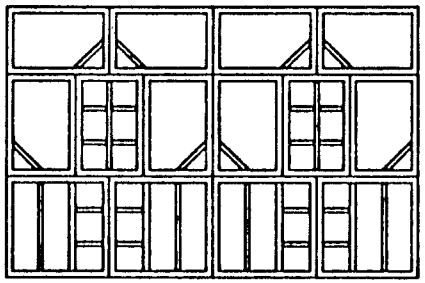

In FIG. 33 a window array 212 includes interplay and continuity between a number of mullions and frame lines. Each mullion appears continuous with either an adjacent mullion or an adjacent pair of abutted frame edges, as seen from the figure. In this overall rectangular window array 212, pairs of sashes are stacked with varying height proportions, but each pair adds up to the same overall height dimensions.

FIG. 35, discussed above, shows sash construction which enables assemblies as shown in FIGS. 28–33 to be made with the appearance of continuous lines. A uniform grid is followed in all cases, with the distance d between mullion center line and frame outer edge being the same as the distance d from mullion to mullion.

FIG. 34, also discussed above, shows in perspective view the manner in which adjacent, abutting sashes may be connected. It should be understood that the sash frames thus connected (and the mullions) may be formed of wood, metal or other materials. Further, as indicated earlier, mullions may be permanent, forming "true divided light" sashes, or they can be add-ins to lie over a single sheet of glass.

The terms "vertical", "horizontal", "up", "down", "above", "below", etc. are used herein for convenience in reference to the drawings. Other orientations than what is shown can be used, and these terms are not meant to be limiting.

The above described preferred embodiment is intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A system of modular window components including a series of rectangular framed window components, comprising, a plurality of rectangular framed window component modules or sashes, each with a frame and means for connection adjacent to an abutting window component module or sash, each rectangular window component module or sash having side and top and bottom dimensions which are equal to those of other, abuttable window sashes of the system, at least some of the sashes being divided light window sashes with mullions dividing the sash into multiple lights or panes, and including at least two different configurations of divided light window sashes, with mullions forming different patterns within the respective different configurations of sashes, the two different configurations of divided light window sashes having dividing mullions which are coordinated with each other as to position in the sash, such that the different sashes can be abutted along their frame edges with termini of the mullions at the respective abutted frames juxtaposed to give an appearance of continuity of the mullions through adjacent sashes, and the different configurations of divided light window sashes including window sashes having obliquely angled linear mullions dividing a window component such that a triangular light is formed in at least one corner, and the distance of each terminus of the oblique mullion from an adjacent frame corner being matched to the position of a mullion terminus at another, dissimilar window sash.

* * * * *